US007743704B2

(12) United States Patent
Icht et al.

(10) Patent No.: US 7,743,704 B2
(45) Date of Patent: Jun. 29, 2010

(54) METHOD OF PRINTING UPON A SOAP BAR

(75) Inventors: Samuel Icht, Ramat-Hasharon (IL); Sharon Maayan, Mobile Post Haela (IL)

(73) Assignee: Photo Print Soap Ltd. (IE)

( * ) Notice: Subject to any disclaimer, the term of this patent is extended or adjusted under 35 U.S.C. 154(b) by 0 days.

(21) Appl. No.: 11/792,858

(22) PCT Filed: Dec. 12, 2005

(86) PCT No.: PCT/IL2005/001338

§ 371 (c)(1),
(2), (4) Date: Jun. 12, 2007

(87) PCT Pub. No.: WO2006/064496

PCT Pub. Date: Jun. 22, 2006

(65) Prior Publication Data

US 2008/0064617 A1 Mar. 13, 2008

Related U.S. Application Data

(60) Provisional application No. 60/635,444, filed on Dec. 14, 2004, provisional application No. 60/668,096, filed on Apr. 5, 2005.

(51) Int. Cl.
*B41F 17/14* (2006.01)
*C11D 13/08* (2006.01)

(52) U.S. Cl. ..... 101/487; 101/35; 101/41; 101/492

(58) Field of Classification Search ..... 101/35, 101/41, 487, 488, 491, 492, 493; 347/4; *C11D 13/08, C11D 13/28*
See application file for complete search history.

(56) References Cited

U.S. PATENT DOCUMENTS

| | | | | |
|---|---|---|---|---|
| 2,051,625 | A | 8/1936 | Watt | |
| 3,432,325 | A * | 3/1969 | Baba Hideshige | 510/142 |
| 4,078,482 | A * | 3/1978 | Goerig et al. | 101/32 |
| 4,297,228 | A | 10/1981 | Kamada et al. | |
| 4,548,825 | A * | 10/1985 | Voss et al. | 426/383 |
| 5,082,495 | A * | 1/1992 | Iijima | 106/31.16 |
| 5,472,545 | A | 12/1995 | Malki | |
| 6,677,296 | B2 * | 1/2004 | Bonsall | 510/446 |
| 2004/0175463 | A1 * | 9/2004 | Shastry et al. | 426/104 |

FOREIGN PATENT DOCUMENTS

| | | | |
|---|---|---|---|
| EP | 1167508 | A1 * | 1/2002 |
| JP | 06192696 | A * | 7/1994 |
| JP | 11116869 | A * | 4/1999 |

* cited by examiner

*Primary Examiner*—Leslie J Evanisko
(74) *Attorney, Agent, or Firm*—Bacon & Thomas, PLLC

(57) ABSTRACT

Method of imprinting on a soap bar or soap sheet which includes steps of providing printed matter on the surface of the soap and isolating the surface from water contact, such that the printed matter is substantially water-insoluble to provide a cost effective soap bar or soap sheet having printed matter on a surface thereon. The surface is protected by a protective layer which is substantially water-insoluble. The protective layer can be a varnish layer printed on transfer paper and affixed to the soap as a label. The printing color is durable in water or other predetermined diluents and in water-soap solution.

12 Claims, 3 Drawing Sheets

METHOD OF PRINTING UPON A SOAP BAR

CROSS REFERENCE TO RELATED APPLICATIONS

This application claims benefit under 35 U.S.C. 119(e) of U.S. Provisional Patent Application Ser. No. 60/635,444, filed Dec. 14, 2004 and U.S. Provisional Patent Application Ser. No. 60/668,096, filed Apr. 5, 2005, the whole of which is incorporated herein by reference.

FIELD OF THE INVENTION

The present invention relates to the field of a means and method of imprinting upon a soap bar.

BACKGROUND OF THE INVENTION

Soap bars are mainly used for washing. In common with other consumer goods, they are distributed from a soap producer to the end user through sale points, but are also marketed as gift products in decorative packaging, or used as sales promotion products distributed free of charge to hotel customers, travel agents' clients and the like. As an advertising or sales promotion product, there is a significant value to the soap decoration as well as to the permanency of the advertised message and its effect on the user. Until now the advertising message has generally been transmitted as a printed text on the soap package, and sometimes also as an engraving on the body of the soap bar.

Soap packaging is generally disposable and therefore discarded upon the first use of the soap. Engraving on the body of the soap is also swiftly erased by erosion and melting of the soap particularly in view of the abrasive nature of its use. Furthermore, engraving is useful only for logo or large size character imprinting, and is inappropriate for small size characters that cannot easily be read on a soap bar, when both characters and bar are the same color.

There is also known in the art a multicolor soap, wherein a wording or a logo is imprinted in the body of the soap by soap segments of a different color.

Known prior art discloses detailed printing that can be imprinted on the surface of a soap bar and last throughout soap use. It therefore may be of interest to soap producers as well as to advertisers to have the ability to imprint detailed items including full color pictures and small size characters on the surface of a soap bar.

There is numerous teaching in the literature for teaching process for marking indicia on a surface. An example of such teaching is U.S. Pat. No. 6,677,296 to Bonsall (referred hereinafter as '296). Patent '296 disclose washing tablets of compacted particulate washing composition which are marked with indicia on their surfaces. The indicia is preferably being of a contrasting color. Patent '296 also discloses processes for applying the markings are also described, as is a combination of the marked tablets with a packaging system.

Patent '296 claims a process for marking indicia on the surface of a tablet of compacted particulate washing composition, characterized in that the indicia are applied by a non-contact marking technique, in which the non-contact marking technique comprises ink-jet printing or laser marking.

Another example of such teaching is EP application no. 1167508 to Duncan (referred hereinafter as '508). Application '508 relates to a cleaning tablet comprising active cleaning components such as water-softening builder and/or bleaching agent, the tablet having an external surface, wherein a design is printed onto at least an area of the external surface. Application '508 also relates to a process for the manufacture of a cleaning tablet, the cleaning tablet comprising active cleaning components such as water-softening builder and/or bleaching agent, the tablet having an external surface, whereby the process comprises the step of printing a design onto at least an area of the external surface.

SUMMARY OF THE INVENTION

A main object of the present invention is thus to provide the ability to imprint detailed items on the surface of a soap bar. It was discovered by the inventors of the present invention that this can be achieved by protecting the soap surface serving as the basis for the imprinted matter from water contact. Such a protected surface will not melt, i.e., dissolve, disassemble, decompose, erode, solubilize or a combination thereof in water or other diluents during use of the soap, thus remaining in a condition appropriate for maintaining imprinted matter on the soap bar surface. In order to prevent melting, i.e., dissolving, disassembling, decomposing, eroding, solubilizing or a combination thereof of at least one soap region, layer or a portion of the same during soap use, this soap region, layer or portion should be coated by at least one material layer or coating or doping means having at least partial water resistance, i.e. which can isolate the soap region coated by it from water contact. It has been discovered that once the soap surface is isolated from water contact, i.e. covered by a layer of water resistant material, the coating layer, enveloping region, surface or doped portion that is glued to, printed on, integrated or a combination thereof with the soap material is at least partially protected from separation from the soap bar, and thus can be used for protecting imprinted matter located *inter alia* between the protective coating layer and the protected soap surface. Furthermore, according to various embodiments of the present invention, wherein the protective layer itself can be imprinted, and wherein at least a portion of the printing color is durable in water or other predetermined diluents and in water-soap solution, it is possible to use a plurality of *n* protective layers as a substrate for at least part of the printed matter which can be imprinted on the soap bar surface, wherein n is any integer number equal or greater than 1.

The present invention also relates in a non-limiting manner to three main imprinting methods by which a full color image may be imprinted on the surface of soap bars:

1. non-contact printing by ink injection devices;
2. contact printing, e.g. tampon printing by in-line or rotational printing machines, or e.g. by silk/screen printing methods; and/or
3. attaching pre-printed decal or label.

A variety of combinations of the above printing methods are also considered to be within the scope of the present invention.

It is also within the scope of the present invention and is part of some of its preferred embodiments, wherein the coating material itself or at least a portion thereof is injected on top of the imprinted matter as if it was another color to be printed. For example, when using said first printing method wherein the printed matter is imprinted on the surface of a soap bar by means of either a semi-automated or a fully automated printing process, using fast high efficiency ink injection printers containing between four and six or seven printing heads (hereinafter also referred to as "injection guns", especially developed for imprinting printing colors and other items on special materials such as soap bars using conventional ink-jet printer mechanisms and for which separate patent applications are to be filed), the coating material can be applied on top of the printed matter by one of the printing heads, as if it was one of the inks.

The coating material may be selected in a non-limiting manner from e.g. FDA approved synthetic food wax alone or admixed with natural bees' wax, or e.g. gelatin or its substitutes, or e.g. any acceptable polymeric material, e.g., polyethylene, polyethylene oxide, PVD, or e.g. alcohol based coating wax, or e.g. paraffin oil, or e.g., cosmetic colorants selected in a non-limiting manner from carotenoids, chlorophylls, flavonoids that include inter alia red or blue anthocyanins and white or pale yellow compounds such as rutin, quercitin, and kaempferol, or e.g., plant extracts, or e.g., inorganic salts, such as Dead Sea Salts in combination with organic or inorganic colorants, or e.g., plant distillates, plant's milled products and powders or any combination thereof. Transparent soap material having low foaming properties may also be an option for use as coating material. The injection of the coating material is possibly performed through one or more injection nozzles or dispensing orifices in the printing head, in communication with the supply system of the coating material, and is preferably controlled by the printer computer to cover only the area printed with the image or the printed matter, possibly with an addition of predetermined surplus to be applied to the surrounding margins for further division between the image and the soap bar area intended for water contact). The printing head is thus adapted according to one embodiment for scanning and injecting the coating material by means of air pressure and/or gravity exactly over or adjacent to the predetermined area defined by the printer's computer. The nozzle, as well as other printing head portions delivering the coating material may be heated or preheated to a predetermined temperature as required for optimizing the injection and/or coating performance of the specific coating material being used.

According to yet further embodiments of the present invention, the soap bar, soap leaf, or soap sheet are provided with at least one layer of coating material by dipping the soap bar surface bearing the printed matter in a bath of liquidized coating material, e.g. a mixture of paraffin oil and bees wax.

It should be appreciated that the coating may also be useful when the printed matter is comprised or made of water durable inks, by providing at least one mechanical protective layer which prevents the melting as defined above as well as scratching or other mechanical damage or alteration to the printed matter, shape, color or quality.

The coating layer is preferably yet not exclusively selected from such materials as mentioned above, and its thickness and appearance are designed such that it will not be visually apparent to the user nor recognizable on touch. By such a design, the soap and the printed matter will appear to be natural, i.e. as if the printed matter was imprinted on the soap body without involving external substances, yet at the same time the printed matter and its coating will be protected from erosion by soap melting.

It is therefore appreciated that according to the present invention only the uncoated regions of the soap are consumed during its use. This however will not significantly affect the user's feeling during washing, since soap melting from uncoated soap regions, very soon covers the protective layer itself, and thus a user will not necessarily recognize that the soap melts from only a part of its surfaces (e.g. from only five of the six surface planes of a cuboid soap bar upon which a protective layer is applied to one of its surfaces).

Accordingly, the process of imprinting matter on a soap bar according to the present invention comprises inter alia steps selected from: imprinting printed matter onto a soap bar or a soap leaf, or alternatively onto a transfer paper to be glued or otherwise affixed to the same and providing the soap bar or soap leaf with at least one predetermined region adapted, by application or at least one isolating layer of water resisting material, to receive or to comprise the said printed matter either upon its surface or adjacent to a surface thereof, thus protecting said printed material from water contact.

According to various embodiments of the invention, the isolating layer or layers comprise at least one varnish layer printed on a transfer paper and then glued or otherwise affixed to the soap as a label. According to these embodiments, the printed matter is glued or otherwise affixed to the soap as a part of the varnish label. According to other various embodiments of the invention, the isolating layer is a wax layer and the printed matter is either printed on the soap body before coating it, or forms part of a varnish label to be glued onto the soap subsequently coated with a wax layer (wherein according to the last variation, the soap surface with the varnish layer is protected twice, i.e. by both the varnish label layer and the wax layer on the surface of and around the varnish labels).

The present invention thus relates according to some embodiments to a label adapted to be printed in a full color process for displaying printed matter, affixed to a soap bar, soap leaf, textured soap, soap sheet etc (hereinafter simply referred to by the term "soap") so that the printing appears to be part of the soap bar, and such that the printing and the label can remain on the soap displaying the printed matter throughout soap use. The present invention also concerns a method of producing a label for a soap bar. It further concerns a label produced according to aforesaid method (hereinafter called the "soap label"). Furthermore, the present invention also relates to a method of incorporating said soap and at least one label to form an integral product comprising said printed matter, appearing to be part of the soap bar. In addition, the present invention also relates to a soap label containing printed matter, which undergoes some reaction upon action of water or other predetermined diluents.

According to another embodiment, the soap label is produced by initially printing a varnish layer on a transfer paper, known also by the terms decal paper, water-slide paper, waterslip paper and more, then printing a target text numbers, photos, picture, codes, images, barcodes, notes, draws, and/or graphics on the varnish layer, hereinafter also referred to as "printed matter").

According to another embodiment, the soap label is produced by initially printing at least a portion of the printed matter on a transfer paper, then imposing a varnish layer on the transfer layer. The varnish layer may be imposed upon the transfer paper by screen printing or by other means.

According to another embodiment of the invention, the printed matter is imprinted using printing methods selected in a non-limiting manner from, ink-jet printing, laser printing, offset process printing, silk (screen) printing or any combination thereof. The printed matter may be multicolor, single color or full colored. The printing of the printed matter may comprise printing in more than one layer, e.g., a background layer of a first color or multicolor graphics, and a second or more additional layers, any of which according to various embodiments of the present invention may be the final layer, or e.g., a textual layer or layers and a graphical layer, multiple printed layers, or any combination thereof. The area of the transfer paper is used for printing any number of labels that may be accommodated thereon, depending inter alia on the predetermined size of labels to be printed and the dimensions of the printed transfer paper sheet, wherein after printing finalization, the transfer paper sheet is cut to receive the intended number of labels each with its pre-designed dimensions.

The next stage consists of removing the transfer paper from the labels. It is acknowledged in this respect that the transfer paper may be removed from the labels before cutting it for separating between a plurality of labels, and incorporating them each separately with a soap bar. There exists in the market a "Decal Blower" device which automatically removes a label by means of a suction cup, then shoots the removed decal label by means of pressurized air to the desired surface. This device or any other device that performs the same function, either hand held or machine mounted, may be used for fast incorporation of labels with a soap bar on a production line.

The removal of the transfer paper from the varnish is performed by immersing the printed transfer paper in water or in any other diluent or solution, it is noted that many manufacturers of such paper recommend suitable diluents for the purpose. By removal of the transfer paper, a transparent varnish-made label body is provided, with printed matter disclosed on the opposite surface.

The label is adhered to the soap using an adhesive material such as the inherent adhesive material provided as a part of the transfer paper. According to this embodiment, the label is adhered and pressed to the surface of soap, while removing trapped air pockets e.g. by dragging a rubber ruler on the labels outer surface.

According to a preferred embodiment of the present invention, the label comprises at least one color-printed layer that reacts upon action of water or soap-water solution, such that it changes its color or transparency, and is thus capable of changing color during use of the soap. According to certain embodiments the color change is reversible, i.e. upon drying of the soap. According to other embodiments the color change is permanent.

According to another embodiment of the invention, the change of color or transparency is used for concealing text or graphics such that they become visible only upon use of the soap with water. Said color or transparency change is used to alter details in the printing, text or the like. The color or transparency change may be utilized either to expose or to hide text and graphics printed as a first layer made of conventional coloring materials, by water reaction with a second layer made of reactive color materials printed on the surface of the first layer (according to said first embodiment) or on the surface of the varnish layer which was printed on the surface of the first layer (according to said second embodiment). According to other embodiments, the reactive color material is used by itself to effect the changes in the printed matter, i.e. independently of additional printed material.

It is appreciated that surprising changes in the printed matter may significantly increase the efficiency of the soap as a sales promotion or advertisement product. It is also appreciated that such surprising changes may be achieved by using reactive colors as described.

TRICKY WHITE® color (known also as TRICK-WEISS®), is a white color reactive with water so as to reversibly change its color, turning transparent upon contact therewith. Using this property, it is possible to print on the varnish layer a first informative layer e.g. by laser printer, then to cover certain portions of the informative layer by screen printing of the TRICKY WHITE®, so that the certain portions of the informative layer that are covered by the TRICKY WHITE® layer become visible only upon contact with water.

During experiments made by the inventor of this invention, it was discovered however that once exposed to a soap-water solution, the ability of the TRICKY WHITE® color to turn from white to transparent is permanently damaged. While efforts have been made to solve this problem, it was found that when used with a soapless soap bar, e.g. such as produced by the Israeli company Neca, the TRICKY WHITE® color maintains its reversible color transfiguration attribute.

In addition it has been discovered during experiments made by the inventor of the present invention, that the incorporation of the varnish treated label and the soap bar may be significantly enhanced by preparing the face of the soap bar to receive the label by a final stage comprising immersing said face of the soap in hot liquidized wax and immediately drawing it out. The wax used by the inventor is a natural FDA approved wax, said wax, preferably an FDA approved wax, is melted using a heating means or at least partially solubilized by a suitable diluent, such that it is suitable to be sprayed or injected. By this process, hereinafter termed also "waxing process" a thin protective unseen wax layer is formed on the outer surface of the label, on the surface of the printed matter and on the soap surface surrounding the label. It has been discovered that natural wax integrates to form one entity with the soap bar material, wherein the wax layer is unaffected by water, and protects the printed matter of the label during whole life time of the soap bar. Furthermore, the wax layer secures the boundary line between the label and the soap, such that an unwanted separation of the label from the soap e.g. by user's nails, becomes harder. However, said final step is not useful for the embodiments where a reactive color material is used, unless the regions printed with the reactive color are isolated from wax contact during the waxing process. This is because the wax layer prevents direct contact between the water and the printed matter, thus inhibiting a reaction between them. As will be further discussed, materials other than wax may also be used to provide a coating with equivalent protective properties. It thus should be appreciated that the present invention does not limit its scope to a specific coating material. Accordingly, when referring to waxing, coating with transparent materials other than wax is included as well, unless this stands in contradiction to the context. It is should also be noted that the present invention also refers to coating by injecting the coating material through a printing head (injection gun), scanning the surface to be coated in a similar manner to that of ink-jet printing process, and thus does not limit its scope to coating by dipping in the coating material.

When using wax for coating, the process is to be performed at a wax temperature of between 85 and 95 Celsius degrees, more preferably of between 91 and 95 Celsius degrees, and most preferably in a temperature of 93 Celsius degrees of the wax, assuming the production line is in room temperature conditions. In some cases, however, when the production line environment conditions vary from the normal, e.g. in terms of room temperature, air humidity, atmosphere pressure, and their relations, the optimal temperature of the wax for the waxing process may vary between about 75 and about 115 Celsius degrees.

It is appreciated that various wax types and combinations may be used in order to obtain optimal waxing, namely a thin polished and uniform coating which can hardly be noticed as differing from the soap. For example, food wax can be mixed with synthetic wax, preferably both are of types approved by a certified authority for food or cosmetic use in ratios of up to several tens of percents, e.g. up to about 30%, 40%, 50% or 60% synthetic wax, wherein such mixing may be useful for adapting the melting temperatures of the wax to varying requirements that may arise on a mass production line, and may also improve flexibility and adhesiveness of the coating to the soap surface. The mixing of two or more wax types or other additional ingredients may be useful for adapting wax qualities, e.g. melting temperature, to manufacturer needs.

According to those embodiments, wherein the coating is made by dipping the printed surface of the soap bars in a bath of coating material, it is also possible to use pure bees wax as the coating substance, which although it has opaque properties, may provide a sufficiently transparent coating layer through the dipping process wherein the entire coating layer is obtained simultaneously with the heated bees wax in liquid state, or through an injection process at sufficiently high temperatures that the bees wax reaches the soap surface in a directed and concentrated hot injection jet of liquidized material. Bees wax can also be used as one of the ingredients in the aforementioned wax type mixtures.

In a further embodiment of the invention the label is glued to the soap either by the adhesive material inherently provided by the transfer paper, or by other adhesive material e.g. porcelain glue, or e.g. MOD PODGE® glue. It should be noted that the varnish material to be used should have acceptable compatibility with the printing materials. For example, the TRICKY WHITE® material requires a special varnish material as a substrate. Both TRICKY WHITE® and the compatible varnish liquid to be used as a substrate are available from the producer of the TRICKY WHITE®.

According to another aspect of the present invention, the soap is printed by tampon printing process such that the printed matter is printed directly onto the soap material, then protected by waxing in the final step.

According to yet another aspect, the soap is printed by non-contact printing process, e.g. ink injection printing.

According to another embodiment of the invention and considering the manufacturer's needs, the printing process is carried out through manual, semi automated or fully automated feeding of the soap bars to the printer, and from the printer to the waxing unit. In a fully automated process, the soap bars are automatically conveyed from their production line to the printer, printed, conveyed to a waxing unit, and finally to a packaging unit. According to one variation the soap bars are conveyed to the printer before the drying step, and are thus being printed while still about 20% wet. Since ink-injection printing is non-contact, it can be applied even to the soft surface of soap bars, where the final drying is taken later on, and where the expected shrinking of the soap bars causes no damage to the printing except to increase somewhat the printing resolution. This is in contrast to the embodiments wherein the soap bars are imprinted on labels and therefore require full drying before gluing the labels in order to prevent label deformation upon shrinking of the soap bar during its drying step.

According to another variation the soap bars are conveyed to the printer after the final drying step.

It is within the scope of the present invention wherein transfer-paper (decal) labels being adhered to the soap bars in semi automated or fully automated process. For the purpose of attaching the decal labels to the soap bars automatically, a pneumatic gun can be used (decal blower) which rapidly removes labels from the transfer paper (e.g. by means of a suction cup) and shoots them onto the soap bar surface by means of air pressure.

According to the description above, and as will be further explained in the description of the figures, the present invention relates to a soap bar having printed matter on a surface thereof, said surface being protected by a protective layer that is substantially water-insoluble.

According to various preferred embodiments the protective layer is formed of varnish. According to other various embodiments the protective layer is formed of wax. According to further preferred embodiments, the protective layer includes both a varnish layer, and a wax layer.

The present invention also considers an embodiment wherein at least part of the printed matter is printed directly onto the surface of the soap, e.g. using tampon printing.

According to various preferred embodiments of the present invention at least part of the printed matter includes a transfer paper attached to the soap (i.e. after separating and discarding the disposable part of the transfer paper).

According to a best mode of the present invention the printed matter includes a tricky color (i.e. reacting with water or with water soap solution to change its visible properties) printed on the protective layer.

The present invention further relates to a soap label comprising a printed matter and a protective layer on a transfer paper.

According to various preferred embodiments of the label the protective layer is printed on the surface of at least part of the printed matter. According to various preferred embodiments at least part of the printed matter is printed on the protective layer.

According to a best mode of the invention the printed matter includes a tricky color.

The present invention relates also to a method for printing a soap bar, the method comprising providing printed matter on a surface of the soap bar and isolating said surface from water contact.

According to another preferred embodiment said surface is isolated from water contact by applying a wax layer.

According to another preferred embodiment said surface is isolated from water contact by attaching a layer of varnish on said surface.

According to another preferred embodiment said surface is isolated from water contact by applying wax to said layer of varnish (and most preferably also to the soap surface surrounding it).

According to other embodiments of the present invention, the method includes printing at least part of the printed matter directly on said surface, e.g. by ink injection or by tampon printing.

According to various preferred embodiments the method of the present invention includes gluing a transfer paper bearing said printed matter to said surface.

BRIEF DESCRIPTION OF THE DRAWINGS

In order to understand the invention and to see how it may be carried out in practice, various preferred embodiments will now be described, by way of non-limiting example only, with reference to the accompanying drawings, in which.

DETAILED DESCRIPTION OF THE INVENTION

Figure 1:
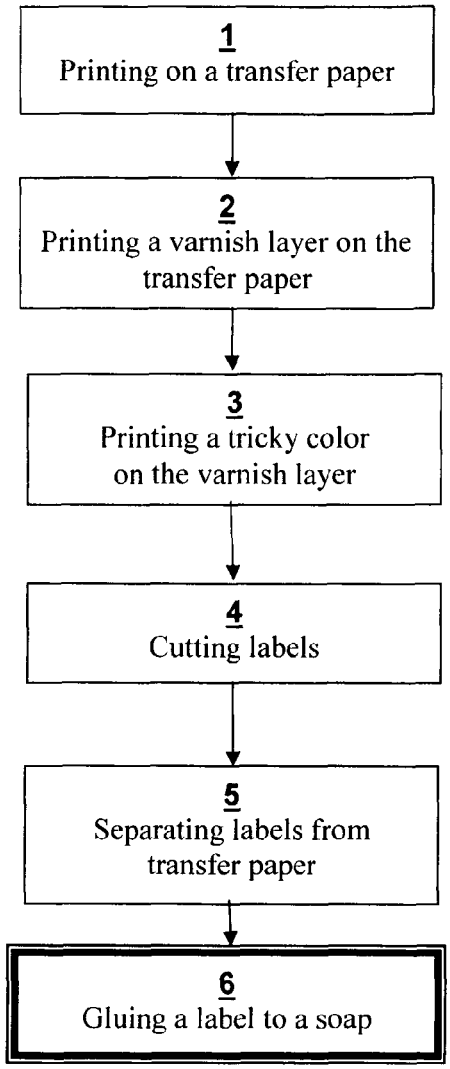
FIG. 1 is a block diagram describing the soap imprinting process according to the first embodiment.

Referring to FIG. 1, a first embodiment of soap imprinting process is described. In step 1 of the process a plurality of printed materials, each intended for imprinting on a surface of one soap bar, are printed onto transfer paper. The printed materials may include text, graphics or pictures, and can be printed by any acceptable printing process. In step 2, the transfer paper is printed by a varnish layer for covering the areas intended to be glued to the soap bars with a thin layer of varnish the varnish layer could be printed using any appropriate printing method, e.g. screen printing. The varnish is of a type adapted for accommodating a tricky color (i.e. a color that reacts with water or with water-soap solution to change its transparency or color) being printed upon its surface without losing its intended tricky attributes. In step 3 the tricky color is printed on the surface of the varnish layer, as a second part of the printed matters, according to a predetermined design aimed to achieve a desired effect of the printed matter upon contact with water. In step 4 the transfer paper is cut into a plurality of label units, each of which having a printed matter intended to be incorporated with a respective soap bar unit. In step 5 labels are separated from the transfer paper by immersing the label units in water, then glued on respective soap units (in step 6), by means of the inherent adhesive material supplied with the transfer paper or by an external glue, e.g. Mod Podge glue. By step 6, the soap surface to which the label is glued becomes isolated from water contact. The label is thin and transparent, such that only the printed material is clearly visible, thus appears to be part of the soap. In all the Figures the steps which relate to providing a protective layer on a surface of the soap bar are marked by a bold line. In the embodiments illustrating two steps marked by a bold line, the protective layer is comprised of two parts.

Figure 2:
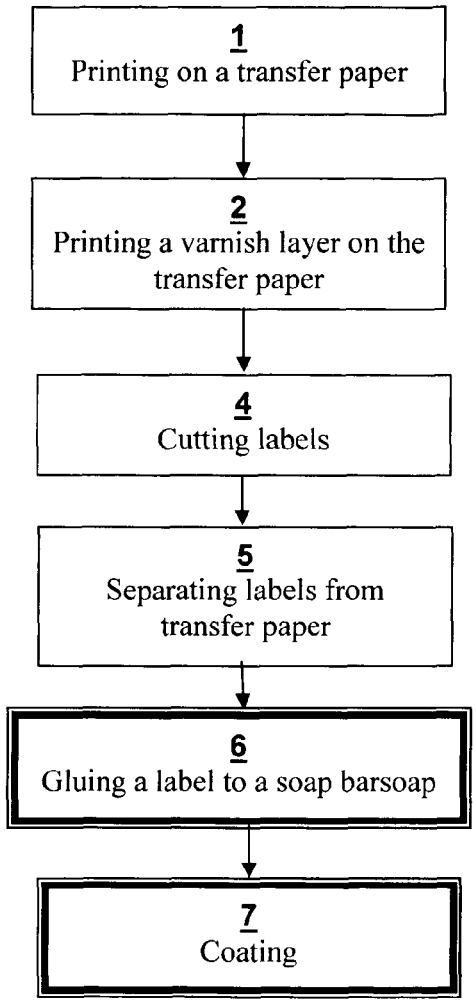
FIG. 2 is a block diagram describing the soap imprinting process according to the second embodiment.

FIG. 2 illustrates a process differing from that of FIG. 1 in that step 3 is missing from the process, and step 7 is added. Accordingly the printed material includes only that part of it printed in step 1, and in step 7 the labels and their surroundings are covered by a protective coating layer of a transparent material, e.g. wax layer thus the soap substrate to which the label is connected is provided with additional protection against water penetration.

Figure 3:
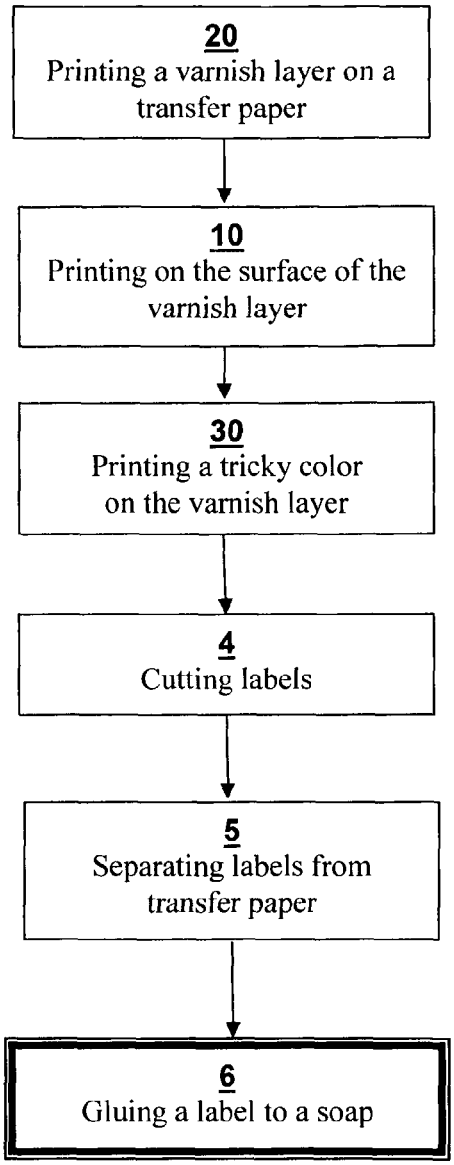
FIG. 3 is a block diagram describing the soap imprinting process according to a third embodiment.

FIG. 3 illustrates a process differing from that of FIG. 1 in that step 1 is missing, and thus, in step 20, the varnish layer is printed first. Then a first part of the printed matter and the second (tricky) part of the printed matter are printed according to this embodiment on the surface of the varnish layer in steps 10 and 30, respectively.

Figure 4:
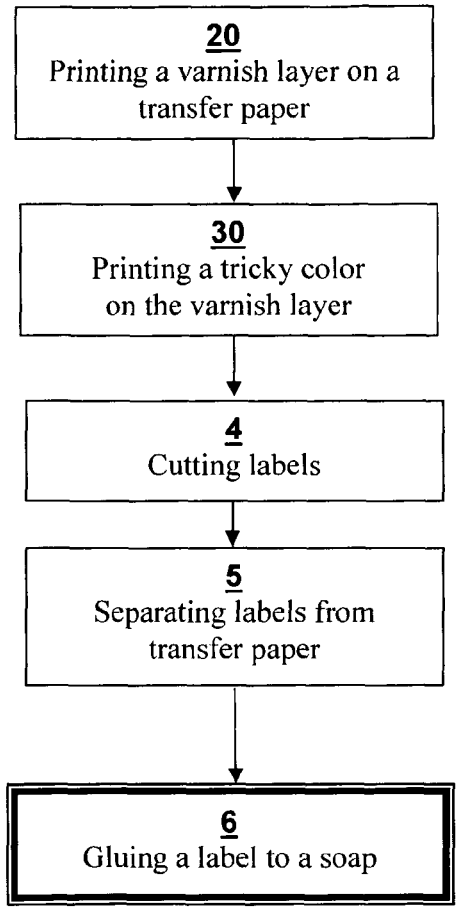
FIG. 4 is a block diagram describing the soap imprinting process according to a fourth embodiment.

FIG. 4 illustrates a process differing from that of FIG. 3 in that step 10 is missing, and thus the printed matter includes only a tricky part according to this embodiment.

Figure 5:
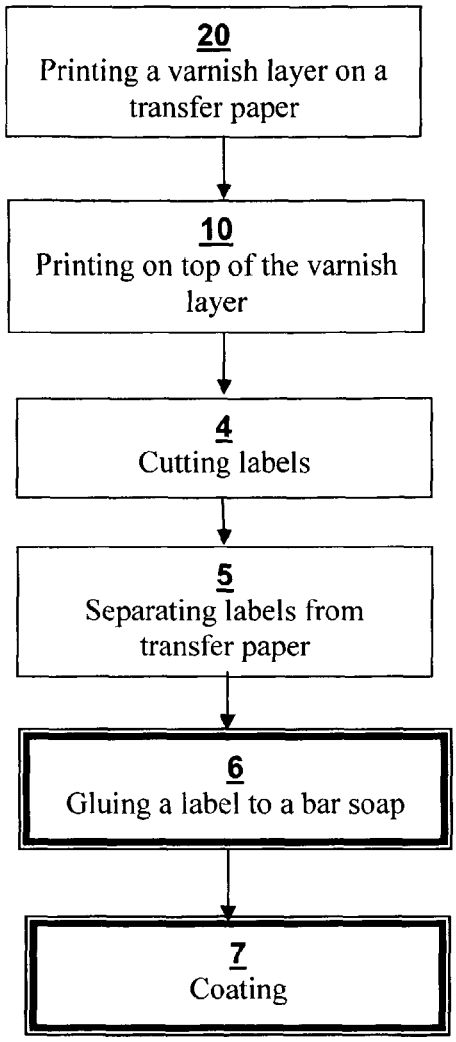
FIG. 5 is a block diagram describing the soap imprinting process according to a fifth embodiment.
Figure 8:
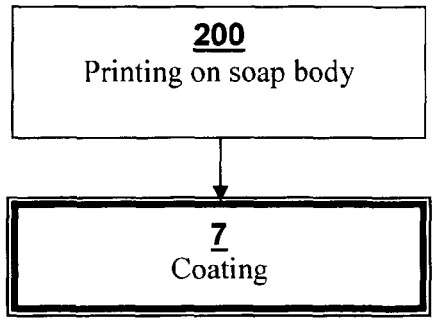
FIG. 8 is a block diagram describing the soap imprinting process according to an eighth embodiment; and, FIG. 9 is a block diagram describing the soap imprinting process according to an eighth embodiment.

FIG. 5 illustrates a process differing from that of FIG. 3 in that step 30 is missing and step 7 is added, and thus the printed matter includes only a conventional (i.e. not tricky) part according to this embodiment, wherein it is printed on the surface of the varnish layer in step 10, and becomes coated and protected by protective coating layer of a transparent material, e.g. a wax layer, in step 7.

Figure 6:
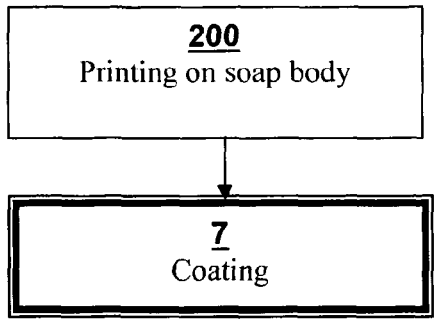
FIG. 6 is a block diagram describing the soap imprinting process according to a sixth embodiment.

FIG. 6 illustrates a process according which the printed matter is printed directly on the soap, e.g. by ink-jet printing process, or e.g. by tampon printing process, then becomes coated and protected in step 7 by a protective coating layer of a transparent material, e.g. a layer of a wax, which not only covers the printing colors but also seals the soap surface from water contact, thus prevents melting of the soap surface being the substrate for the printed material.

Figure 7:
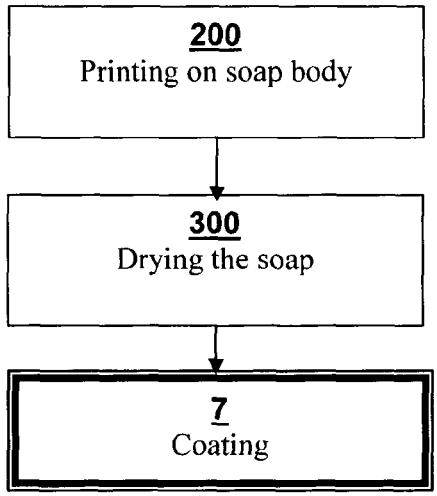
FIG. 7 is a block diagram describing the soap imprinting process according to a seventh embodiment.

FIG. 7 illustrates a process according which the printed matter is printed directly on the soaps, e.g. by ink injection printing process, or e.g. by tampon printing process, in step 200, wherein the printing is performed before full drying of the soap bars. After the printing the soap bars are conveyed for a drying unit in step 300, and after drying they are conveyed to a coating unit for being coated and protected in step 7 by a protective layer of e.g. a wax, which not only covers the printing colors but also seals the soap surface from water contact, thus prevents melting of the soap surface being the substrate for the printed material.

The term "raw and un-pretreated" refers hereinafter to the crude surface of the soap without pre-treating it prior to printing or ink-jetting an ink on said crud surface of the soap.

Figure 9:
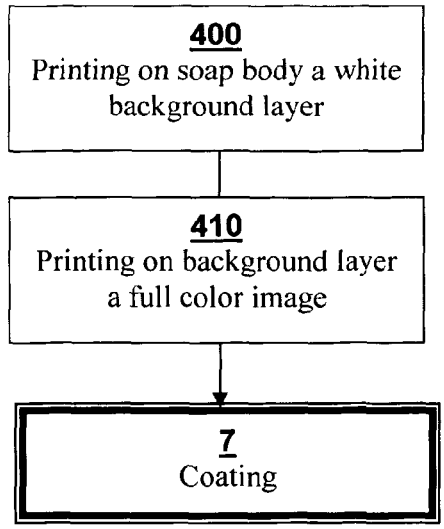

FIG. 9 illustrates a process according which the printed material is printed directly on the soaps, by full color printing process, wherein the soap bar's own color is dark, or not white, and thus in order to allow clear observation of the printed image, in a first step 400 a white color (or alternative white-toned color) layer is printed by a first injection gun of the printer, thereafter in step 410 a four color process image being printed by means of four additional injection guns, and finally, a protective coating layer being printed on the surface of the image by means of a sixth injection gun in step 7. Optionally, a seventh injection gun may be used for printing special aromatic substance or any other substance required for creating a desired special effect.

Other embodiments involving different combinations of the above mentioned processes or parts thereof, or involving additional steps or providing additional protective layers, may be implemented without departing from the scope of the present invention as defined by the claims.

The invention claimed is:

1. A method of direct printing a printed matter on a soap bar or a soap sheet, said method comprising steps of:

a. providing said soap bar or said soap sheet whilst said soap bar or said soap sheet is partially wet;

b. providing an inkjet printer and inkjet ink therein; said inkjet ink is heated to a predetermined temperature as required for optimizing coating performance and for better adhesion of said inkjet ink to the surface of said soap bar or said soap sheet;

c. ink-jetting said heated inkjet ink directly onto at least one surface of said soap bar or said soap sheet; wherein said inkjet ink is in direct physical contact with said surface;

d. applying at least one water-immiscible printed matter protective layer onto said ink-jetted soap surface; thereby sealing said soap surface from water contact;

wherein said ink is printed onto said soap bar or said soap sheet, while said soap bar or said soap sheet is partially wet, in said ink-jetting step before fully drying said soap bar or said soap sheet.

2. The method of claim 1, additionally comprising step (e) of attaching at least one layer of varnish thereon for isolating the surface from water contact.

3. The method of claim 2, further comprising applying wax to said layer of varnish.

4. The method of claim 1, additionally comprising isolating said surface from water contact by applying at least one wax layer.

5. The method according to claim 1, wherein said step of ink-jetting said heated inkjet ink is performed whilst said soap is still about 20% wet.

6. A method of direct printing a printed matter on a soap bar or a soap sheet, said method comprising steps of:

a. Providing said soap bar or said soap bar sheet whilst said soap bar or said soap sheet is partially wet;

b. providing a printer adapted for contact printing and ink therein; said ink is heated to predetermined temperatures as required for optimizing coating performance and for better adhesion of said ink to the surface of said soap bar or said soap sheet;

c. contact printing said heated ink directly onto at least one surface of said soap bar or said soap sheet; wherein said ink is in direct physical contact with said surface;

d. applying at least one water-immiscible printed matter protective layer onto said printed soap surface; thereby sealing said soap surface from water contact;

wherein said ink is printed onto said soap bar or said soap sheet, while said soap bar or said soap sheet is partially wet, in said printing step before fully drying said soap bar or said soap sheet.

7. The method of claim 6, additionally comprising step (e) of attaching at least one layer of varnish thereon for isolating the surface from water contact.

8. The method of claim 7, further comprising applying wax to said layer of varnish.

9. The method of claim 6, additionally comprising isolating said surface from water contact by applying at least one wax layer.

10. The method according to claim 6, wherein said step of printing said heated ink is performed whilst said soap is still about 20% wet.

11. The method according to claim 6, wherein said step of printing said contact printing method is selected from a group consisting of: tampon printing method, silk printing method, screen printing method, or any combination thereof.

12. The method according to claim 6, wherein said step of providing said contact printing machine is selected from a group consisting of: in-line printing machine, rotational printing machine, or any combination thereof.

* * * * *